US006330856B1

(12) United States Patent
Fitzgerald et al.

(10) Patent No.: US 6,330,856 B1
(45) Date of Patent: Dec. 18, 2001

(54) GARMENT DISPENSING AND RECEIVING APPARATUS

(75) Inventors: Robert M. Fitzgerald, Norcross; Eugene O. Gresens, Suches; Ward P. Broom, Snellville, all of GA (US)

(73) Assignee: Innovative Product Achievements, Inc., Duluth, GA (US)

( * ) Notice: Subject to any disclaimer, the term of this patent is extended or adjusted under 35 U.S.C. 154(b) by 0 days.

(21) Appl. No.: 09/238,758

(22) Filed: Jan. 28, 1999

(51) Int. Cl.[7] ..... B30B 15/28; B30B 7/00

(52) U.S. Cl. ..... 100/52; 100/102; 100/229 A; 100/233; 221/102; 221/135; 232/43.3

(58) Field of Search ..... 100/52, 99, 229 A, 100/102, 233; 221/102, 135; 232/1 B, 43.3; 312/211, 224, 327, 328

(56) References Cited

U.S. PATENT DOCUMENTS

| | | | |
|---|---|---|---|
| 165,252 | | 7/1875 | Pike . |
| 2,446,807 | | 8/1948 | Blair et al. . |
| 2,478,815 | | 8/1949 | Forman . |
| 2,653,693 | * | 9/1953 | Dosberg ..... 221/102 |
| 2,766,906 | | 10/1956 | Bookout et al. . |
| 2,888,307 | | 5/1959 | Graves et al. . |
| 2,986,304 | | 5/1961 | Barnhart . |
| 3,010,608 | | 11/1961 | Lyons . |
| 3,249,294 | | 5/1966 | Hughes et al. . |
| 3,455,621 | | 7/1969 | Kingsley . |
| 3,489,315 | | 1/1970 | Craven, Jr. et al. . |
| 3,696,737 | | 10/1972 | Wikner . |
| 3,728,849 | | 4/1973 | Lundahl . |
| 3,752,061 | | 8/1973 | Hirsch . |
| 4,519,308 | | 5/1985 | Eberle . |
| 4,522,061 | | 6/1985 | Hochreuther et al. . |
| 4,552,061 | | 11/1985 | Brutsman . |
| 4,594,942 | | 6/1986 | Denneboom . |
| 4,788,909 | * | 12/1988 | Stewart ..... 100/102 |
| 4,807,779 | | 2/1989 | Clapper . |
| 4,896,593 | | 1/1990 | Slusser . |
| 4,967,928 | | 11/1990 | Carter . |
| 5,385,265 | | 1/1995 | Schlamp . |
| 5,638,985 | | 6/1997 | Fizgerald et al. . |
| 5,713,270 | | 2/1998 | Fitzgerald et al. . |
| 5,829,349 | | 11/1998 | Fitzgerald et al. . |

* cited by examiner

*Primary Examiner*—Stephen F. Gerrity
(74) *Attorney, Agent, or Firm*—Alston & Bird LLP

(57) ABSTRACT

An apparatus and method for dispensing and retrieving garments in a controlled manner. The apparatus retrieves the garments in a secure enclosure while accounting for the garments returned, and compacts the returned garments, all with a single, stand-alone apparatus. A paddle mechanism sweeps the garments into a horizontally extended storage compartment and compacts them with an upward movement. The paddle is articulated at a one-way joint to allow it to pass obstructions on its return path.

16 Claims, 6 Drawing Sheets

GARMENT DISPENSING AND RECEIVING APPARATUS

TECHNICAL FIELD

The present invention relates to a system for dispensing and retrieving garments, and particularly relates to dispensing garments in a controlled manner, receiving the garments in a secure enclosure while accounting for the garments returned, and compacting the returned garments, all with a single, stand-alone apparatus.

BACKGROUND ART

Some employers must provide special clothing to their employees, then collect and launder the clothing when it becomes soiled. Hospital scrubsuits are an example of such clothing. A problem associated with the use of scrubsuits is loss of inventory as a result of negligence, misuse and theft. Another problem is extra laundering of unused scrubsuits as a result of mishandling.

To avoid the labor costs and other disadvantages of staffed dispensing stations within a hospital, vending machines have been developed, such as that shown in U.S. Pat. No. 5,638,985. This apparatus effectively solves the problems involved in vending flexible cloth items one at a time. The dispenser includes a processor that tracks the inventory within the machine as scrubsuits are removed, and limits users to a maximum number of withdrawals with a magnetic card or "PIN" number access system.

The clothing collection apparatus shown in U.S. Pat. Nos. 5,713,270 and 5,829,349 also reduces inventory loss. Scrubsuits are checked in by the user, and a processor sends a credit to the user's account via a communications network. Thus, the return of a scrubsuit increases the scrubsuits available to that user from a scrubsuit vending machine also linked to the network. The apparatus also compacts the garments that are returned.

In large hospitals, placing individual dispenser units and receiving units at key locations has proved effective in controlling an inventory of scrubsuits. However, a system of separate dispensers and receiving units connected by a communications network may be too expensive for small hospitals, clinics, or hospital departments that need to maintain an inventory of scrubsuits independent of a large hospital organization. Thus, there is a need for a compact unit that can dispense and retrieve garments such as hospital scrubsuits.

Adapting the garment receiving apparatus of the unit shown in U.S. Pat. Nos. 5,713,270 and 5,829,349 into a compact unit presents difficulties, because the collection compartment into which the garments are compacted is located directly below the compacting mechanism. Thus, the volume of clothing that the collection area can hold is limited by the height and width of the unit. To increase the capacity of a garment collection compartment, a compaction system is needed that can move and compact garments into a laterally extending collection compartment.

SUMMARY OF THE INVENTION

The present invention seeks to provide an apparatus that can receive and pack goods, such as garments or the like, laterally with respect to their intake location.

This object is accomplished by providing an apparatus for receiving and packing goods, comprising a storage chamber including an outer wall defining an inlet opening, and an inlet chamber positioned adjacent to the storage chamber and communicating with the inlet opening. An articulated paddle is mounted for rotation about a pivot axis, the paddle being positioned at least partly within the inlet chamber and defining a one-way folding joint at a location between the pivot axis and an outer end of the paddle. A drive mechanism is connected to rotate the paddle in both directions about the pivot axis from an initial position at least partly within the inlet chamber toward the storage chamber and back to the initial position. The joint holds the paddle in an extended configuration against resistance when the paddle is rotating toward the storage chamber, and allows the paddle to fold when the paddle is rotating back toward the initial position.

In one embodiment, the drive mechanism is capable of rotating the paddle into the storage chamber. The initial position of the paddle may lie in a plane adjacent to a wall of the inlet chamber, and the drive mechanism may be capable of rotating the paddle into the storage chamber and through an angle greater than 210° (preferably about 220–225° or more) from the initial position. The apparatus may include a resistance sensor operative to reverse rotation of the paddle toward the storage chamber responsive to the paddle encountering a preset level of resistance from goods in the storage chamber. A first position sensor may be located along the rotation of the paddle at an angle indicating the storage chamber is full; and a controller may be connected to the first position sensor and generate a full signal in response to the paddle being reversed by the resistance sensor prior to reaching the first position sensor.

Preferably, the drive mechanism includes a motor coupled to rotate the paddle, and the apparatus further includes a second position sensor located along the rotation of the paddle at a predetermined angle from the initial position of the paddle. In this case the controller is connected to the second position sensor and disconnects energy to the motor in response to the second position sensor indicating passing of the paddle during return motion of the paddle toward the initial position, allowing the paddle to coast into the initial position.

The storage chamber may include a bag and the inlet chamber may comprise a chute positioned above the inlet opening of the bag. The bag may extend horizontally from the inlet opening. The inlet chamber can be equipped with a lockable receiving door, an input device for acquiring user identification information, and a controller operatively connected to unlock the door and to operate the drive mechanism in response to information received from the input device. Preferably, a sensor is positioned to provide a confirmation signal to the controller indicating the presence of goods in the inlet chamber. The controller updates an inventory of goods and an account of a particular user associated with the information received from the input device in response to the confirmation signal.

The present invention also provides a method for receiving and packing goods, comprising the steps of accepting goods into an inlet chamber; operating a sweep arm from an initial position through an angle of up to about 220° or more to sweep the goods from the inlet chamber into a storage chamber having an inlet opening communicating with the inlet chamber; monitoring movement of the sweep arm past at least first and second locations distant from the initial position; returning the sweep arm toward the initial position responsive to resistance to continued movement thereof at any angle from the initial position; allowing the sweep arm to coast back to the initial position from the first location; and if the sweep arm returns without passing the second location, terminating acceptance of goods into the inlet chamber. The step of operating the sweep aim to pack the goods may optionally be initiated less than upon every acceptance of goods into the inlet chamber for a predetermined number of acceptance cycles, to reduce the average cycle time for users, and thereafter the sweep arm may be operated after every acceptance to assure that the inlet chamber is cleared and the goods are properly packed.

The present invention also seeks to provide a compact unit that both dispenses and receives cloth items.

This object is accomplished by providing an apparatus for dispensing and receiving goods, comprising: a cabinet; a dispensing device for cloth items positioned in an upper portion of the cabinet; a receiving chamber positioned adjacent to the dispensing device in the upper portion of the cabinet and including an opening through which cloth items may be inserted into the receiving chamber; a storage chamber positioned in a lower portion of the cabinet and extending beneath both the receiving chamber and the dispensing device, the storage chamber defining an opening communicating with the receiving chamber; and a sweeping arm operative to move cloth items to a portion of the storage chamber beneath the dispensing device. In a preferred embodiment, the sweeping aim moves between a position within the receiving chamber to a position within the storage chamber.

Other objects, features and advantages of the present invention will become apparent upon reviewing the following detailed description of an embodiment of the invention, when taken in conjunction with the drawings and the appended claims.

DETAILED DESCRIPTION

Figure 1:
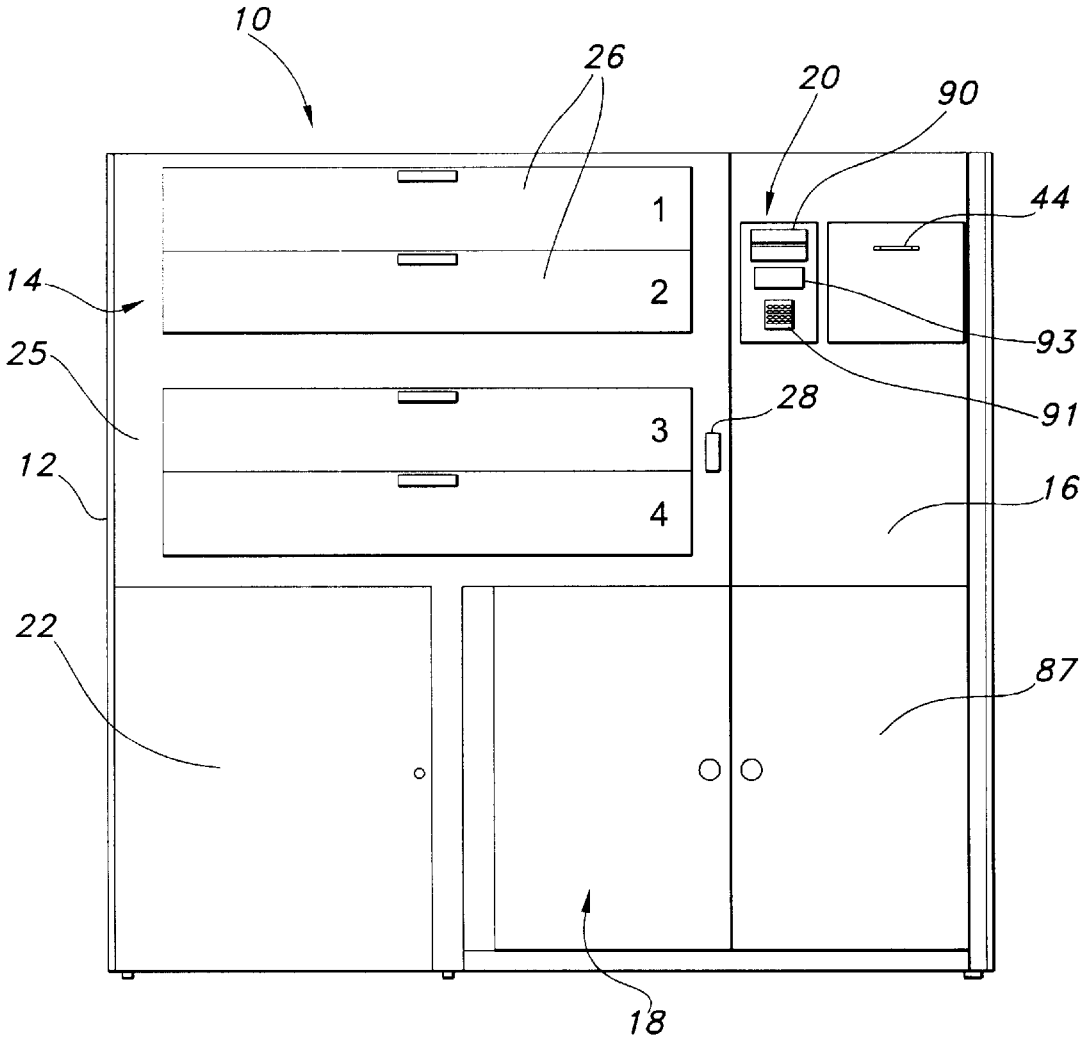
FIG. 1 is a front plan view of a garment dispensing and retrieving apparatus embodying the present invention.
Figure 2:
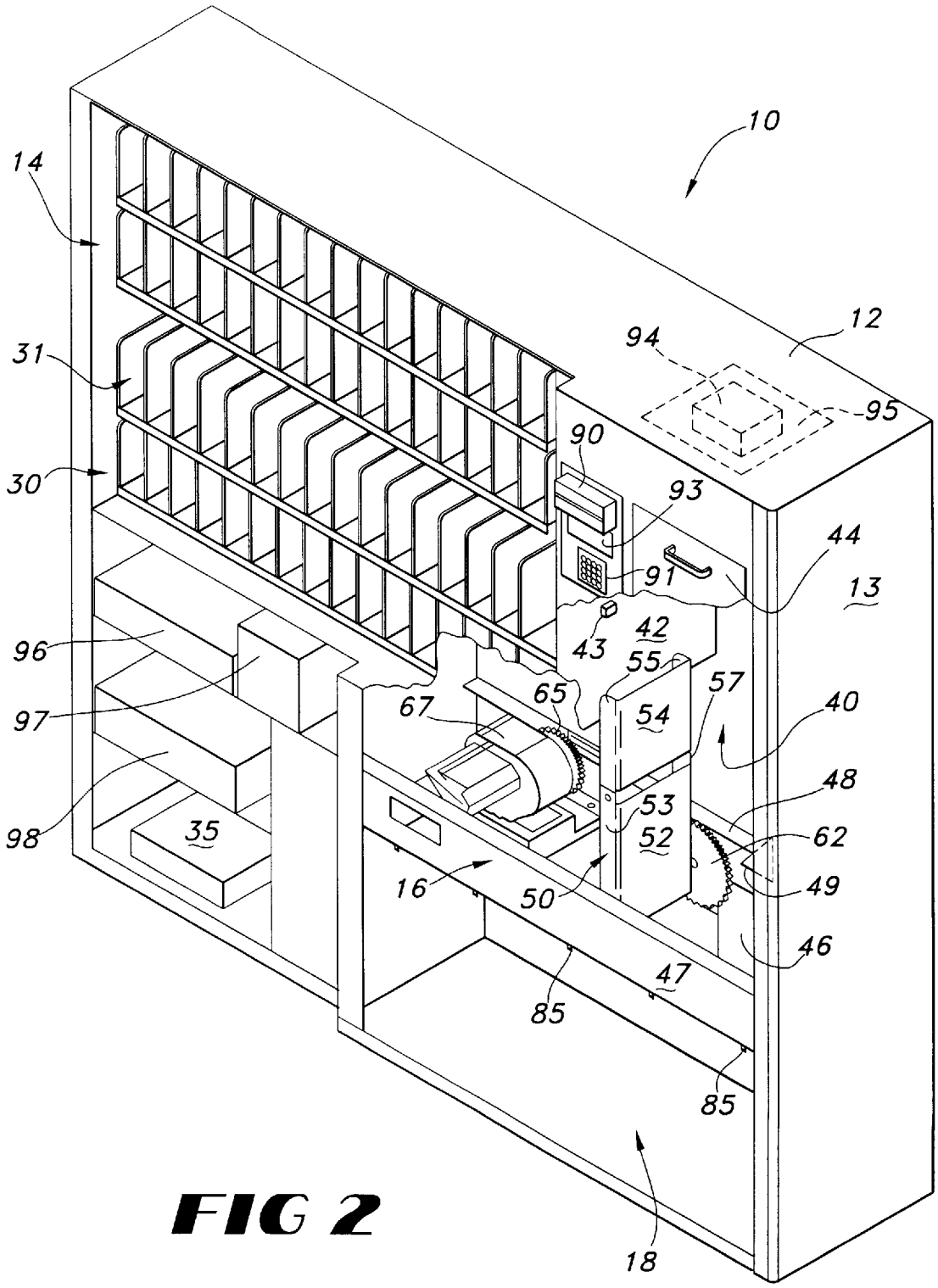
FIG. 2 is a pictorial view of the apparatus of FIG. I showing interior components.
Figure 5:
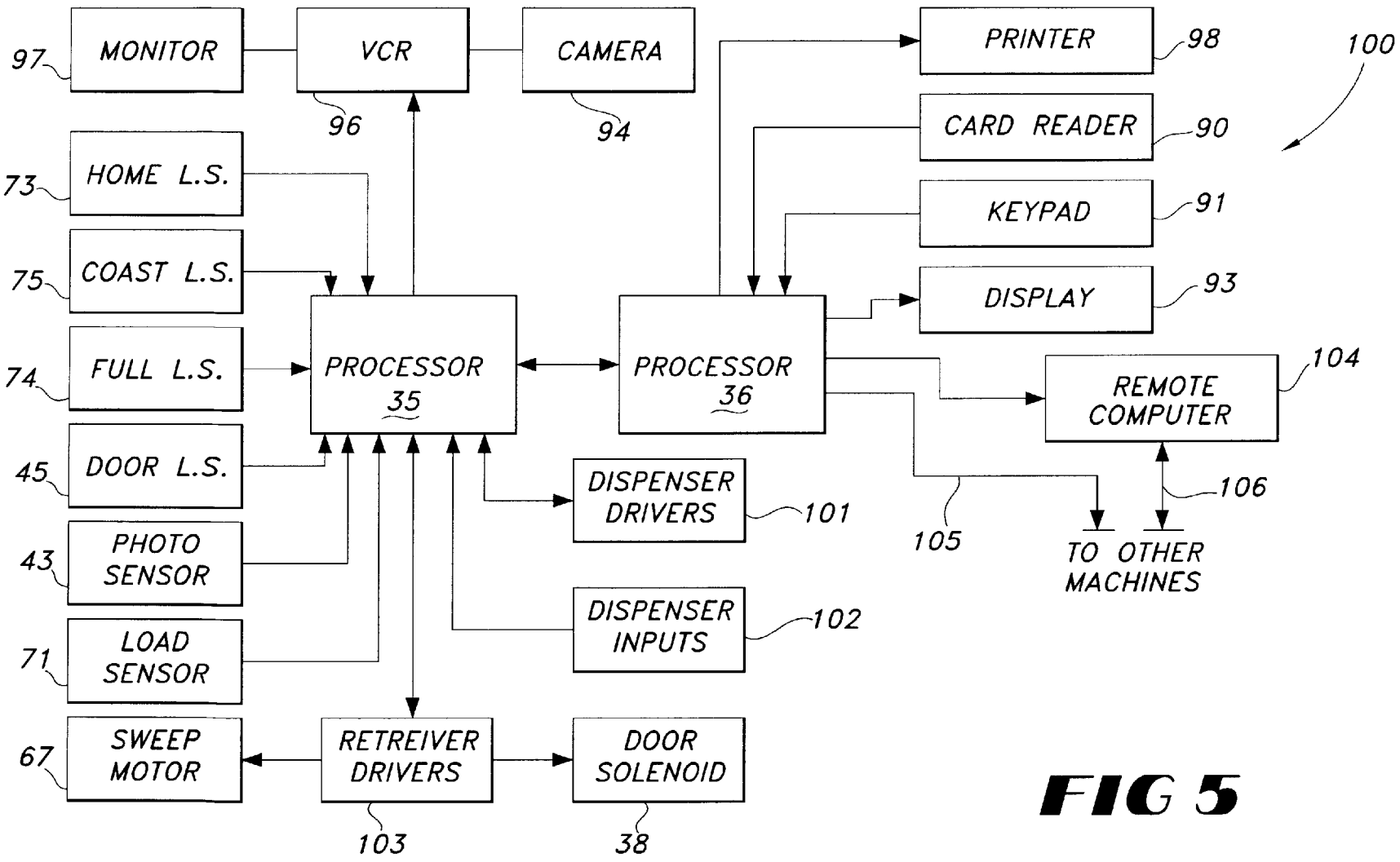
FIG. 5 is a block diagram of a control circuit for operating the apparatus of FIG. 1.

Referring now in more detail to the drawings, in which like numerals refer to like parts throughout the several views, FIG. 1 shows a garment dispensing and retrieving machine 10 embodying the present invention. The machine 10 is contained within a cabinet 12 which holds both a dispensing mechanism 14 for dispensing garments or sets of garments, and a retrieving mechanism 16 for receiving garments returned by users. The retrieving mechanism 16 directs the returned garments into a storage compartment 18. Users and attendants operate the machine 10 via a controller interface panel 20, which contains input devices described below connected to electronic devices associated with the panel 20 and in an electronics compartment 22, including a programmed microprocessor 35 in the compartment 22 and a programmed microprocessor 36 with the panel 20 (FIGS. 2 and 5). A portion of the storage compartment 18 extends under the dispensing mechanism 14, as shown in FIG. 1.

The dispensing mechanism 14 is of the type shown in U.S. Pat. No. 5,638,985. Because the mechanism is described in detail in that patent, its structure and operation will be summarized briefly here. Referring to FIGS. 1 and 2, the dispensing mechanism 14 is positioned in the upper left corner of the cabinet 12. A plurality of user doors 26 are defined in a main dispenser door 25, which is secured by a locking latch 28. A number of receptacles or slots 31 are arranged behind the user doors 26 on shelves 30, forming an array of the dispensing slots 31 in which garments such as surgical scrubsuits are disposed. Receptacle doors (not shown) allow access to only one column of slots, so that when one user door 26 is open, only one slot is accessible.

Figure 3:
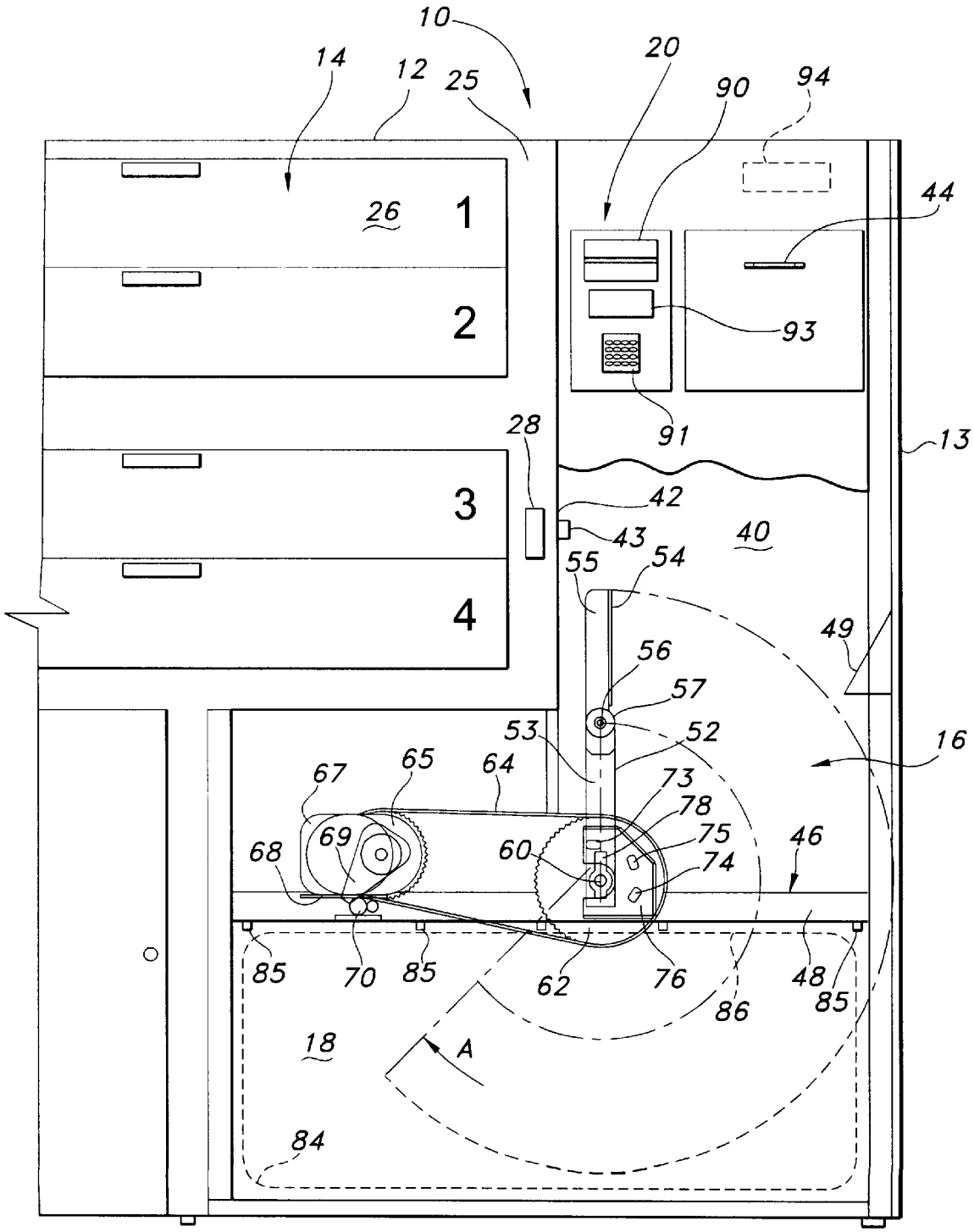
FIG. 3 is a partial front plan view of the apparatus of FIG. 1 with doors removed to show interior detail.

Referring to FIGS. 2 and 3, receiving mechanism 16 is positioned in a portion of the cabinet 12 to the right of, and below the right hand portion of, the dispensing mechanism 14. An inlet chamber or chute 40 is defined between an inner wall 42 separating the inlet chamber 40 from the dispensing mechanism 14, and an outer wall 13 of the cabinet. A door 44 in the front of the cabinet allows users to deposit soiled garments into the inlet chamber after entering a proper identification via the interface panel 20. Associated with the door 44 are a lock solenoid 38 and a limit switch 45 that indicates whether the door is closed (both shown diagrammatically in FIG. 5). When garments are deposited through the door 44, they fall past a photosensor 43 which confirms that an article has in fact been deposited. As they continue to fall, the garments pass into the storage compartment 18 through an inlet opening 46 defined between (a) a front beam 47 extending across the top of the storage compartment, (b) a rear beam 48 parallel to the front beam and positioned against the back wall of the cabinet 12, (c) the end wall 13 of the cabinet, and (d) an articulated paddle 50. The falling garments are deflected toward the paddle 50 by an angled guide 49 extending across the end wall of the cabinet, best shown in FIG. 3.

Figure 4:
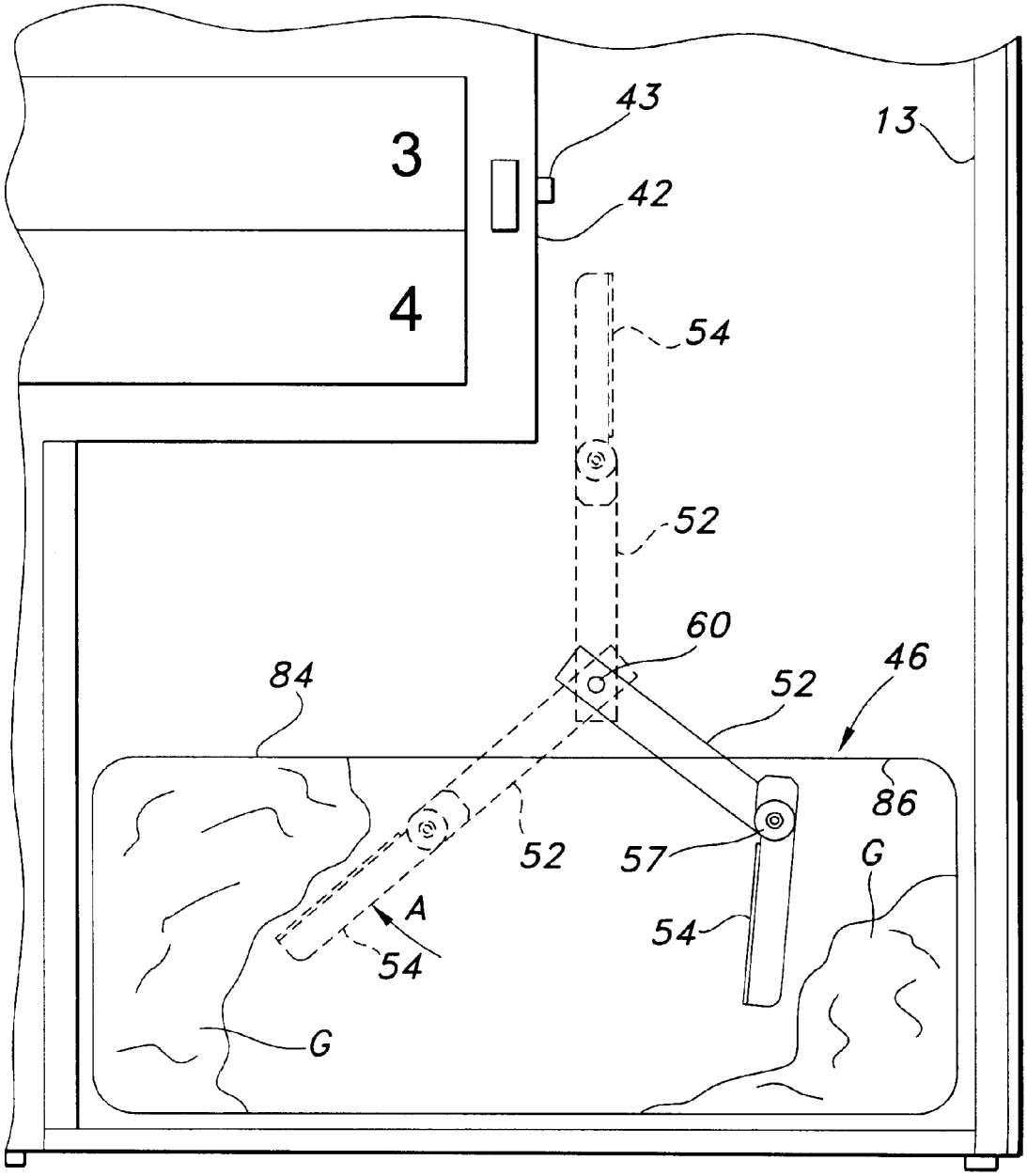
FIG. 4 is a diagrammatic front view of the paddle and drive mechanism showing various positions of the paddle.

The articulated paddle 50 has an inner paddle member 52 and an outer paddle member 54 connected at a pivot joint 57. The inner paddle 52 has a broad, flat surface and defines a pair of side flanges 53 for strength extending away from the inlet chamber. Similarly, the outer paddle member 54 has a broad, flat surface and defines a pair of side flanges 55. FIG. 3 shows a cross section of the paddle 50, with the paddle members biased into linear alignment by a spring 58. The outer paddle member 54 extends past the joint and partly behind the inner paddle member 52, so as to provide a stop, preventing the members 52 and 54 from bending about the joint 57 beyond linear alignment in one direction. However, pressure against the outer paddle member 54 will bend it about the joint, against the force of the spring 58, in a Counterclockwise direction as viewed in FIG. 3. The one-way knee joint thus formed by the pivot joint 57 may take on positions such as shown in FIG. 4, which is described in more detail below in connection with the operation of the apparatus.

The inner paddle member 52 is fixed to a pivot axle 60 that may be journaled in bearings (not shown) mounted on each of the rails 47 and 48. The axle is positioned so that when the paddle 50 extends vertically upward, it is adjacent to the wall 42. A sprocket 62 also is fixed on the axle 60. The sprocket 62 is driven via a chain 64 by another sprocket 65 mounted on the drive shaft of a reversible motor/gear reducer 67. The motor is mounted on a platform 68 extending between the rails 47 and 48 in a space below the dispensing mechanism 14. If desired, the paddle can be driven clockwise by the motor and returned in the counterclockwise direction by a spring or other resilient device. An arm 69 also is mounted to the drive shaft of the motor 67. The arm's path intersects a stop 70 mounted below the motor platform 68.

As shown by the dashed lines in FIG. 3, the clockwise rotational path of the distal end of the paddle 50 about the axle 60 sweeps from an approximately vertical (or "home") position, across the inlet chamber near the guide 49, between the rails 47 and 48 closely adjacent to the cabinet wall 13, through the storage compartment 18, past 180° of rotation within about 2–3 inches of the floor of the storage compartment 18, and to a final position about 225° from the home position, as indicated by the arrow A. When the paddle 50 is in the home position, the arm 69 abuts the left side of the stop 70 as viewed in FIG. 3. When the paddle has rotated to its final position, the aim 69 abuts the right side of the stop 70. The motor is equipped with a conventional resistance sensor 71, shown diagrammatically in FIG. 5, connected to stop the motor when the motor must strain beyond a predetermined level attempting to rotate its drive shaft. This may occur when the arm 69 contacts the right side of the stop 70, or earlier when the paddle 50 encounters resistance from stored garments as described below.

The position of the paddle 50 is monitored using limit switches positioned on a plate 76 mounted adjacent to the axle 60. A home position limit switch 73 is located approximately vertically above the axle 60, a full position sensor 74 is located at about 120° counterclockwise from the vertical, and a coast position sensor 75 is located about 70° from the vertical. As the axle 60 rotates, a cam 78 mounted on the axle 60 trips each of the three limit switches.

The home position is designed to have a fairly wide range to allow for differences in overtravel of the paddle as it coasts. Therefore, the home position limit switch 73 is positioned so that it is tripped at some point before the arm 69 contacts the stop 70, and will stay tripped from that point for the entire travel distance of the arm 69 to the stop.

The storage compartment 18 may be lined with an impervious storage bag 84 hanging on hooks 85 positioned along the rails 47 and 48. The bag 84 is generally the shape of the storage compartment, for example, rectangular, and defines an opening 86 at the opening 46 leading from the inlet chamber 40. An operator can access the bag 84 for removal and replacement through doors 87, on which is a limit switch 88 (shown diagrammatically in FIG. 5) that indicates whether the door is closed. The bag opening 86 may be closed when removed from the compartment 18.

The controller interface 20 includes a bar code or magnetic card reader 90 and a keypad 91 for allowing a user to input identification information, as described in U.S. Pat. Nos. 5,638,985, 5,713,270, and 5,829,349, which are incorporated herein by reference in their entirety. For example, a user can be required to initiate a dispensing or return operation by swiping a card or by entering a user number and then keying in a PIN. An LCD or LED display 93 shows information to the user, such as whether the user is authorized, whether the requested size is available, and whether or not the user has credits available. The display may also present instructions to the user on how to operate the apparatus 10. Optionally, a video or still camera 94 may be positioned behind a horizontal window 95 within the cabinet 12 above the door 44 to look down into the inlet chamber 40. The camera may be connected to a video tape recorder 96 and/or a television monitor 97 located in the electronics compartment 22. This equipment may be used to record transactions for security and verification. A printer may also be located in the compartment 22 to allow easy printing of data stored in the memory of the processor 36.

FIG. 5 shows a block diagram of a control system 100 for operating the combined dispensing and receiving apparatus 10. The microprocessors 35 and 36 includes memory (not shown) for storing software modules for operating the apparatus 10. This software is responsive to various inputs from sensors and input devices described above and issues signals to operate various components of the apparatus. The dispensing mechanism 14 is operated in the manner described in U.S. Pat. No. 5,638,985. Input signals 102 from the dispensing mechanism 14 are shown diagrammatically. Software drivers 101 for operating the motors, solenoids, etc., of the dispensing mechanism 14 are also shown diagrammatically.

The same microprocessors 35 and 36 may control both the dispensing and receiving mechanisms. The processor 36 at the panel 20 includes a memory that stores information about the location and contents of each receptacle, such as whether the receptacle is full and the sizes of the garments it contains. A program in the processor 36 allows an operator who is loading the machine with new scrubsuits to use the keypad 91 to modify the full/empty status of each slot in the memory. In the alternative, a remote computer 104 may program the sizes for each slot. The memory of the processor 36 also stores the "credits" allocated to each user and not previously used.

At the interface panel 20, the card reader 90, keypad 91, and display 93 are controlled by the processor 36, the memory of which holds a list of authorized card numbers. Each user can initiate a dispensing operation by entering a user number and personal identification number (PIN) at the user interface panel 20 in a manner described below. The processor 36 is programmed to determine whether a set of garments meeting the needs of that user is in inventory, and in which receptacle that set is located. If the correct garment is present, the processor 36 instructs the processor 35 to operate the mechanism to move the receptacle doors to expose the column of receptacles 31 in which that slot is located, and unlocks the user door 26 at that row. After the user withdraws the set of garments in the receptacle and closes the door, the processor 35 locks the door and updates the memory to reflect the empty status of that receptacle, and updates the user's credit account.

The processor 35 controls the operation of all the motors and solenoids for the apparatus 10, and receives input signals from switches as needed to open the correct slot requested by the processor 36. For the retrieving mechanism 16, the processor 35 also includes retriever drivers 103 for operating the door solenoid 38 to lock and unlock the door 44, and for operating the sweep motor 67 to move the paddle 50. To determine when to operate these devices, the processor 35 utilizes inputs from the load sensor 71 associated with the motor 67, the paddle position limit switches 73, 74, and 75, the door limit switch 45 on the door 44, and the photosensor 43 in the inlet chamber. Inputs to the processor 36 include data read by the card reader 90 and input via the keypad 91. The processor 35 sends signals to control the VCR 96. Separately, the processor 36 controls the display 93 and the printer 98. The apparatus 10 may be linked to other systems, for example a remote central computer 104. The processor 36 may obtain information on individual user accounts from the central computer 104, and return data regarding usage at the apparatus 10. The processor 36 also may be networked along a data link 105 to other dispensing/receiving machines with links 106 to the central computer 104. This data communication facilitates operation of a multi-station system within a large hospital or covering more than one small hospital or clinic. Further details of network operation are found in U.S. Pat. No. 5,638,985 and 5,713,270, and 5,829,349.

Figure 6:
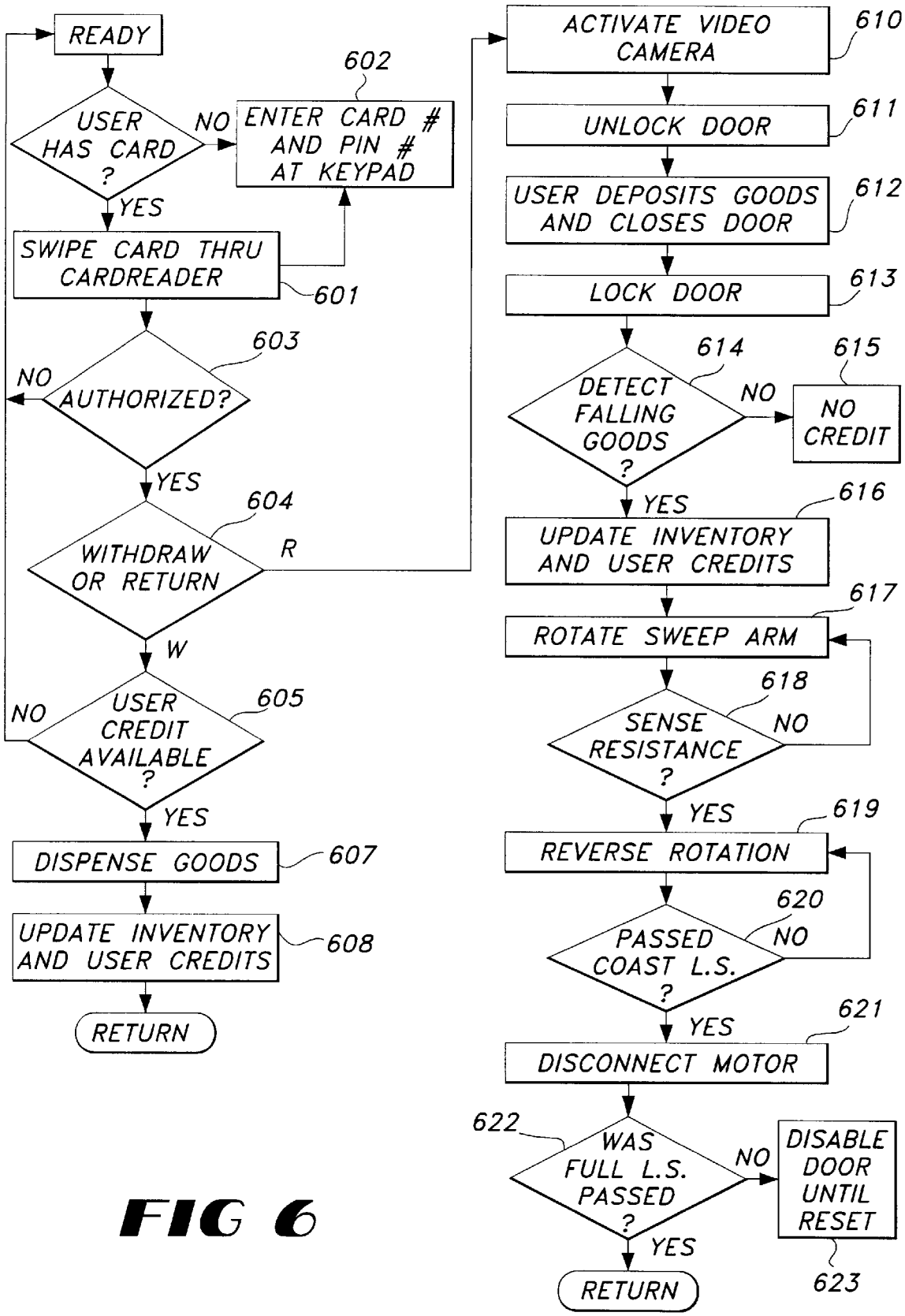
FIG. 6 is a logic flow diagram of the steps in the operation of the apparatus of FIG. 1.

Operation of the combined dispensing and receiving apparatus 10 will be described with the aid of the flow diagram of FIG. 6. A user approaches the apparatus 10 and at step 601, swipes a bar code or a magnetic card through the card reader 90, or at step 602, enters a card number and PIN number at the keypad 91. The user selects the desired mode of operation (withdraw or return garments) at the keypad 91. These entries may be prompted by the display 93. At step 603 the processor determines whether the bar code or the magnetically entered user number or keypad entered user number and PIN number are valid. If not, the program returns to the ready mode. If so, the processor at step 604 allows the user to select whether or not to withdraw or return garments on his or her account.

If the choice is to withdraw garments from the dispensing mechanism 14, the program proceeds to step 605 where the processor determines whether the user has credit available to make a withdrawal. If so, the dispensing process continues as described in U.S. Pat. No. 5,638,985. The steps there described will not be repeated in detail, such as receiving a requested size and determining and reporting whether the requested size is available and proper for the user. The dispensing process may proceed at step 607 to dispense a garment from one of the slots 31, and the inventory and user credit history may be updated at step 608.

If the user has chosen to return garments at step 604, the The processor activates the video camera 94 at step 610 to record what is actually deposited into the inlet chamber 40, and unlocks the return door solenoid 38 at step 611. At step 612, the user opens the return door 44 and deposits the garments into the door and closes it. The door limit switch 45 detects the closing of the door 44, and the processor locks it by releasing the solenoid 38 which allows a spring latch (not shown) to lock the door at step 613. As the garments fall through the inlet chamber 40, they trigger the photocell sensor 43 at step 614, which sends a signal to the processor 35 which sends data to the processor 36 confirming that a deposit did accompany the door opening and closing. If the sensor 43 does not detect a passing article, the processor 36 determines at step 615 that no credit will be given to the user's account.

When garment confirmation is made at step 616, the processor 36 adds one set of garments to the user's credit account. Also, after a garment has triggered the sensor 43, the processor 35 causes the motor 67 to begin rotating the axle 60, and with it, the paddle 50 and the cam 78.

Referring to FIG. 4, as the paddle rotates from the home position, it pushes garments G within the inlet chamber 40 into the storage compartment 18, preferably into the bag 84. Continued rotation of the paddle sweeps the garments toward the inner portion of the storage compartment 18 under the dispensing mechanism 14. The paddle 50 may or may not pass the full limit switch 74, depending on the contents of the storage chamber. If so, a signal is received by the processor 35. During this clockwise rotation, the paddle 50 remains straight, and rotates until it encounters resistance from compacted garments if sufficient garments are present. The movement of the paddle on encountering resistance will compact the garments first in the inner, upper corner of the compartment 18 with an upward movement of the paddle, as shown in FIG. 4 with the paddle in dashed outline. Then, sufficient resistance triggers the resistance sensor associated with the motor 67, which signals the processor to reverse rotation of the paddle at step 619. If only a few garments are in the storage compartment, the paddle will reach its maximum travel at the angle A (225°) and the arm 69 will engage the stop 70, causing the motor to reverse in the same way.

As the paddle 50 moves counterclockwise, some garments it has compressed may fall back from the corner. Such garments will be packed into the corner again on the next cycle of the paddle. Also during return motion, the paddle may engage garments G within the storage compartment. The full line position of the paddle 50 in FIG. 4 shows the paddle members 52 and 54 articulated about the joint 57 to pass by garments G. Sufficient force has been placed on the paddle member 54 to bend it about the joint 57. As soon as the paddle clears the garments G, the spring 58 will straighten the paddle members, so that in the home position the paddle will be approximately vertical, and will not be in the path of garments deposited into the inlet chamber 40.

During return movement of the paddle 50 counterclockwise toward the home position, the paddle triggers the coast limit switch 75. At step 620, the processor 35 monitors the coast limit switch. Until it is triggered, the motor 67 continues to drive in reverse. When the limit switch 75 is triggered by the cam 78, power to the motor is disconnected at step 621, allowing the paddle to coast into the home position. If there is enough coast, the arm 69 on the motor meets the stop 70. When the home limit switch 73 is triggered, the processor checks at step 622 to determine whether the full limit switch 74 was passed during the preceding paddle cycle. If not, this indicates the storage compartment 18 is full, and further operation of the receiving mechanism 16 is disabled at step 623 until the compartment 18 is cleared (for example, by removing and replacing the bag 84). A signal indicating the apparatus 10 is full is sent to the processor 36 and may be sent to the central computer 104, and a "FULL" message may be shown on the display 93. If the full limit switch was passed during the previous cycle, then the compartment 18 has more capacity and the program returns to the ready state until another user logs in.

An operator may check on the apparatus 10 periodically, or when the inventory data maintained on the central computer 104 indicates the storage compartment 18 is full, or the dispensing mechanism 14 is empty or needs restocking in certain sizes. The operator has key access to the storage doors 87 and to the latch 28 of the dispenser main door 25. The operator may restock the empty slots. The programming of which size should be loaded into which slot is performed at the computer 104 and displayed on the display 93 to the operator. However, if the apparatus 10 is not connected to a computer 104, the operator logs in the slots that are loaded using the keypad 91.

The operator may also remove and close the bag 84, and install another bag 84 in the storage compartment 18. The receiving mechanism 16 is automatically reset when the limit switch 88 indicates that the door 87 has been opened. In this case a door open signal is sent to the processor 35, which informs the processor 36 that the storage compartment 18 has been emptied. Safety switches (not shown) on the doors 87 prevent operation of the motor 67 while the doors 87 are open. When the operator finishes servicing the apparatus 10, he or she resets the control circuit 100 to allow further access by users as described above.

In one embodiment of the invention, the processor 36 is programmed to operate the paddle mechanism only periodically when the storage chamber 18 is relatively empty. There is no need under these conditions to pack the garments after every deposit, and the packing steps can be skipped for all but one of every five to ten cycles of accepting returned garments. This procedure eliminates the time of operation of the paddle from the majority of deposit cycles, and therefore beneficially reduces the average cycle time that users must wait for the apparatus to become ready for another deposit. After a predetermined number of deposit cycles, for example between 50 and 60 deposit cycles, the receiving mechanism may pack the garments after every deposit to insure that the scrubsuits do not back up into the inlet chamber 40 and are properly packed.

It is possible to use a stock confirmation terminal of the type shown in U.S. Pat. No. 5,638,985 in connection with the apparatus 10, but this may not be desired with the smaller dispensing mechanism 14.

The present invention may be practiced using variations in the embodiment described above. As will be clear from the foregoing, an apparatus can be constructed that can receive and pack goods, such as garments or the like, laterally with respect to the location of the intake and compacting mechanisms. Also, a compact apparatus can be constructed that will that both dispense and receive cloth items.

What is claimed is:

1. An apparatus for dispensing and receiving goods, said apparatus comprising:

a cabinet;

a dispensing device for cloth items positioned in an upper portion of said cabinet;

a receiving chamber positioned adjacent to said dispensing device in said upper portion of said cabinet and including an opening through which cloth items may be inserted into said receiving chamber;

a storage chamber positioned in a lower portion of said cabinet and extending beneath both said receiving chamber and said dispensing device, said storage chamber defining an opening communicating with said receiving chamber; and an arm movable in a first direction from an initial position to an extended position and movable back toward said initial position in a second direction opposite to said first direction, to move cloth items to a portion of said storage chamber beneath said dispensing device.

2. An apparatus for dispensing and receiving goods, comprising:

a cabinet;

a dispensing device for cloth items positioned in an upper portion of said cabinet;

a receiving chamber positioned adjacent to said dispensing device in said upper portion of said cabinet and including an opening through which cloth items may be inserted into said receiving chamber;

a storage chamber positioned in a lower portion of said cabinet and extending beneath both said receiving chamber and said dispensing device, said storage chamber defining an opening communicating with said receiving chamber; and an arm movable to sweep cloth items to a portion of said storage chamber beneath said dispensing device;

wherein said arm moves between a position within said receiving chamber to a position within said storage chamber.

3. An apparatus for dispensing and receiving goods, comprising:

a cabinet;

a dispensing device for cloth items positioned in an upper portion of said cabinet;

a receiving chamber positioned adjacent to said dispensing device in said upper portion of said cabinet and including an opening through which cloth items may be inserted into said receiving chamber;

a storage chamber positioned in a lower portion of said cabinet and extending beneath both said receiving chamber and said dispensing device, said storage chamber defining an opening communicating with said receiving chamber; and an arm movable to sweep cloth items to a portion of said storage chamber beneath said dispensing device, said arm comprising:

a) an articulated paddle mounted for rotation about a pivot axis and defining a one-way joint at a location between said pivot axis and an outer end of said paddle;

b) a drive mechanism connected to rotate said paddle about said pivot axis from an initial position toward said storage chamber and back toward said initial position; and c) said joint holding said paddle in an extended configuration against resistance when said paddle is rotating toward said storage chamber; and allowing said paddle to fold when said paddle is rotating back toward said initial position.

4. The apparatus of claim 3, wherein said drive mechanism is capable of rotating said paddle into said storage chamber.

5. The apparatus of claim 4, wherein in said initial position of said paddle assembly said paddle lies in a plane adjacent to a wall of said receiving chamber, and wherein said chive mechanism is capable of rotating said paddle into said storage chamber and through an angle greater than 180 degrees from said initial position.

6. The apparatus of claim 5, wherein said angle is greater than 210° from said initial position.

7. The apparatus of claim 6, wherein said angle is about 225° or more from said initial position.

8. The apparatus of claim 4, further comprising a resistance sensor operative to reverse rotation of said paddle toward said storage chamber responsive to said paddle encountering a preset level of resistance from goods in said storage chamber.

9. The apparatus of claim 8, further comprising a controller connected to said drive mechanism and to said resistance sensor.

10. The apparatus of claim 9, further comprising a first position sensor located along the rotation of said paddle at an angle indicating said storage chamber is full; said controller being connected to said first position sensor and generating a full signal in response to said paddle being reversed by said resistance sensor prior to reaching said first position sensor.

11. The apparatus of claim 10, wherein said drive mechanism includes a motor coupled to rotate said paddle, and further comprising a second position sensor located along the rotation of said paddle at a predetermined angle from said initial position of said paddle; said controller being connected to said second position sensor and disconnecting energy to said motor in response to said second position sensor indicating passing of said paddle during return motion of said paddle toward said initial position, whereby said paddle coasts into said initial position.

12. The apparatus of claim 3, wherein said storage chamber comprises a bag and said receiving chamber comprises a chute positioned above an inlet opening of said bag.

13. The apparatus of claim wherein said bag extends horizontally and said chute extends vertically upward from said inlet opening.

14. The apparatus of claim 3, further comprising:

a lockable receiving door in said receiving chamber;

an input device for acquiring user identification information; and a controller operatively connected to unlock said door and to operate said drive mechanism in response to information received from said input device.

15. The apparatus of claim 14, further comprising a sensor positioned to provide a confirmation signal to said controller indicating presence of goods in said receiving chamber, said controller updating an inventory of goods and an account of a particular user associated with said information received from said input device in response to said confirmation signal.

16. The apparatus of claim 3, wherein said drive mechanism comprises a reversible motor.

* * * * *

UNITED STATES PATENT AND TRADEMARK OFFICE

CERTIFICATE OF CORRECTION

PATENT NO. : 6,330,856 B1
DATED : December 18, 2001
INVENTOR(S) : Fitzgerald et al.

It is certified that error appears in the above-identified patent and that said Letters Patent is hereby corrected as shown below:

Column 10,
Line 30, “chive” should read -- drive --;
Line 65, “claim” should read -- claim 12 --.

Signed and Sealed this

Twentieth Day of August, 2002

*Attest:*

*Attesting Officer*

JAMES E. ROGAN
*Director of the United States Patent and Trademark Office*